United States Patent [19]

Jeremic

[11] Patent Number: 4,909,107

[45] **Date of Patent: * Mar. 20, 1990**

[54] ADJUSTABLE WRENCH

[76] Inventor: Miodrag Jeremic, 405 - 310 Alexander Street, Vancouver, British Columbia, Canada, V6A 1C4

[ * ] Notice: The portion of the term of this patent subsequent to Aug. 30, 2005 has been disclaimed.

[21] Appl. No.: 287,027

[22] Filed: Dec. 21, 1988

[30] Foreign Application Priority Data

Aug. 30, 1988 [CA] Canada ..... 576095

[51] Int. Cl.[4] ..... B25B 13/16

[52] U.S. Cl. ..... 81/166

[58] Field of Search ..... 81/165–168, 81/177.1, DIG. 1

[56] References Cited

U.S. PATENT DOCUMENTS 1,552,091 9/1925 Thewes ..... 81/167 X
2,613,567 10/1952 Tenerowicz et al. ..... 81/166 X
4,520,699 6/1985 Jeremic ..... 81/166
4,766,786 8/1988 Jeremic ..... 81/166 X

FOREIGN PATENT DOCUMENTS 244119 4/1943 Switzerland ..... 81/166
301884 1/1929 United Kingdom ..... 81/166

*Primary Examiner*—James G. Smith
*Attorney, Agent, or Firm*—Murray E. Thrift; Stanley G. Ade; Adrian D. Battison

[57] ABSTRACT

An adjustable wrench has a wrench head with a cavity for receiving an object to be gripped and a moveable key that slides into the cavity to adjust its size. The key is advanced and retracted by an actuating mechanism including a threaded stem and a nut. The stem and key can be disconnected and separately removed from the wrench for repair or replacement. The wrench handle has a series of belt holes spaced along it so that the wrench can be belted to the body of a wearer as a safety measure.

8 Claims, 2 Drawing Sheets

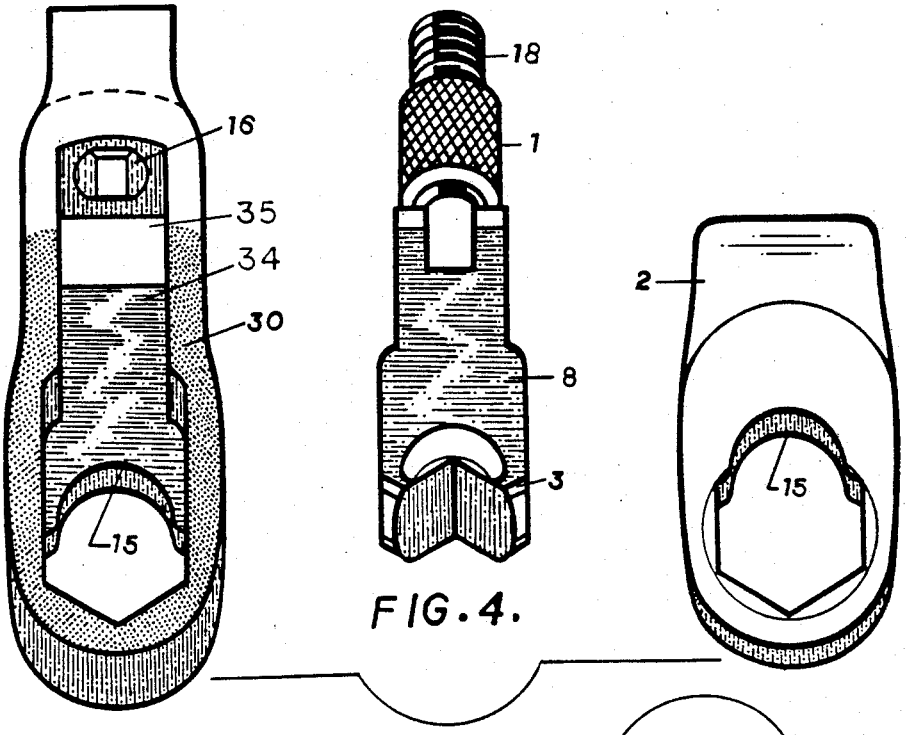
FIG. 4.
FIG. 5.
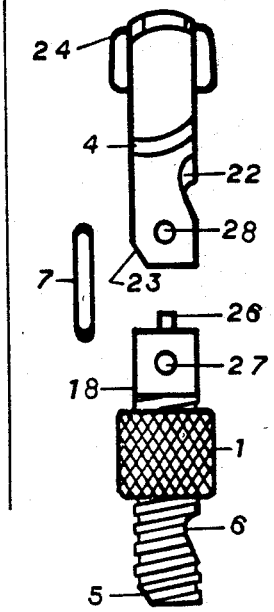
FIG. 6.
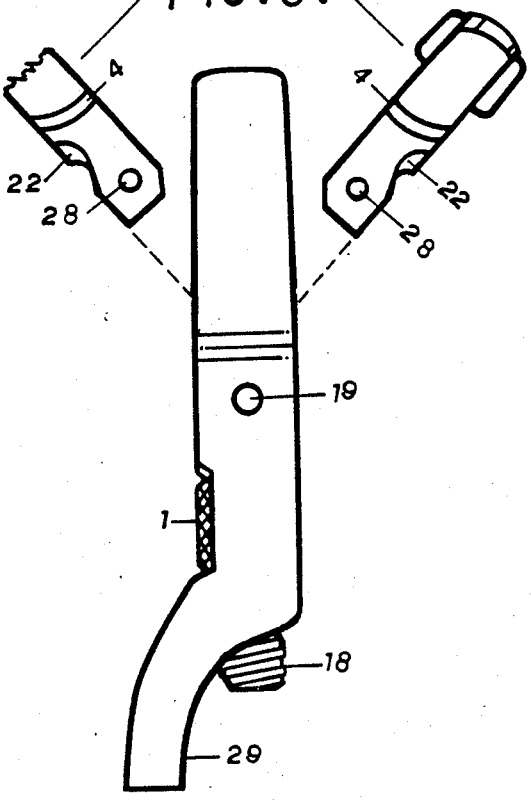

ADJUSTABLE WRENCH

FIELD OF THE INVENTION

The present invention relates to an adjustable wrench of the type having a movable key and a key adjustment assembly for advancing and retracting the key in a nut receiving cavity.

BACKGROUND

In most prior art adjustable wrenches of the type in question, the key and the adjustment assembly are captive and cannot be removed for maintenance or replacement.

In my U.S. Pat. No. 4,520,699, issued June 4, 1985, I have disclosed a wrench in which the adjustment mechanism can be removed from the wrench body for servicing or replacement. However, the key remains captive and cannot be removed from the wrench head.

In my U.S. patent application Ser. No. 003,084 filed Jan. 14, 1987, I have disclosed a wrench in which both the key and the adjustment mechanism can be removed and replaced through the gripping cavity of the wrench. However, the nut engaging face of the key is narrower than the opposed face of the cavity, and does not extend fully to one side of the wrench. The key, the adjustment mechanism and the wrench head are all asymmetrically inter-related so that the key and the adjustment mechanisms must be inserted from one side only of the wrench head.

The present invention aims at the provision of an improved wrench of this type.

SUMMARY

According to the present invention there is provided an adjustable wrench comprising:

a handle;

a wrench head attached to the handle, said wrench head having a gripping cavity therethrough, with a first end of the gripping cavity, remote from the handle, configured for engagement with an object to be gripped, an elongate passage in the wrench head opening into the cavity opposite the first end thereof, and a transverse passage through the wrench head, intersecting the passage at a position spaced from the cavity;

a key comprising an elongate body slideable within the axial passage of the head, and having a gripping end projecting into the cavity and an attachment end opposite the gripping end, the gripping end having a gripping end face confronting the first end of the gripping cavity and a pair of lips projecting from opposite sides of the key to extend the gripping face to opposite side faces of the wrench head, the key body having bevelled edges at the corners of the gripping face, a bevelled surface on a first surface adjacent the attachment end and a transverse, arcuate notch formed across a second surface directly opposite the first surface;

key adjustment means for moving the key along the elongate passage and comprising a threaded stem fixed against rotation within the elongate passage and adapted to engage the end of the key, removable securing means for removably securing the key and stem to one another, a nut engaged with the threaded stem, seated in the transverse passage and projecting to opposite sides of the wrench head;

an access port in the wrench head providing access to said elongate passage so that said securing means can be removed to separate said key and said threaded stem;

said key being removable from said elongate passage by removing said securing means, extending said key into the cavity sufficient to position said notch against an edge of the cavity opposite the first end thereof, and pivoting said key about the edge out of the plane of the gripping cavity for removal from said elongate passage through the gripping cavity, the bevelled surfaces of the key providing sufficient clearance with the surfaces of the elongate passage and the gripping cavity to allow the key to be pivoted in such a manner;

said threaded stem being removable from said elongate passage by rotating the said nut to move the threaded stem out of the elongate passage for removal.

As a preferred safety feature, the handle of the wrench is provided with elongate belt holes of varying length spaced along the handle. These allow the wrench to be belted to the user's body, for example under a coverall, and carried safely to the location where it is intended to be used. The adjustability of the wrench makes it eminently suitable as a tool to be carried to locations that are relatively difficult to reach as only a single wrench need be carried reducing the burden on the carrier and increasing his mobility.

BRIEF DESCRIPTION OF THE DRAWINGS

In the accompanying drawings, which illustrate an exemplary embodiment of the present invention:

FIG. 4 is an exploded view of the wrench head and of the key and adjustment mechanism;

FIG. 5 is an exploded view from the side of the key and adjustment mechanism; and FIG. 6 is a side view of the wrench head illustrating the manner in which the key may be inserted from either side.

DETAILED DESCRIPTION

Figure 1:
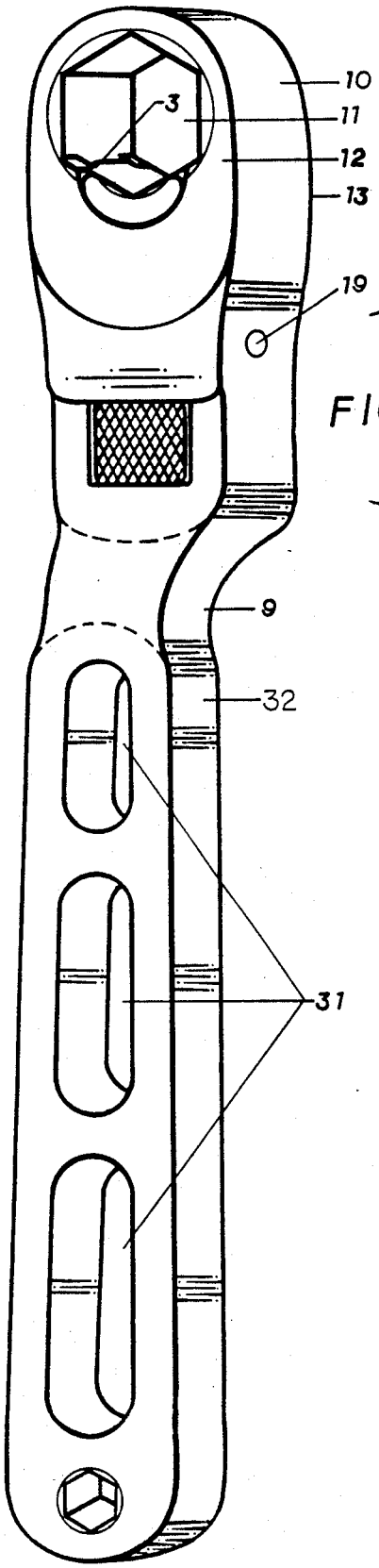
FIG. 1 is a front isometric view of a wrench.
Figure 2:
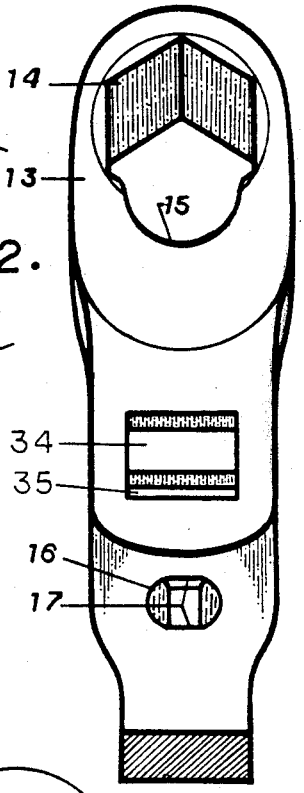
FIG. 2 is a view from the back and below of a wrench head with the key and adjustment mechanism removed.

Referring to the accompanying drawings FIG. 1 illustrates a wrench, generally indicated at 9, with a wrench head 10 and a handle 32. The wrench head 10 is provided with a cavity 11 for receiving nuts, bolt heads and the like. The wrench head has a forward face 12 and a rearward face 13 as illustrated in FIGS. 1 and 2. The gripping cavity 11 has an end 14 configured as two flats angled at 120° to engage the flats of a conventional hex nut or bolt head. The opposite side of the cavity has two arcuate, concave edges 15 on opposite sides of an elongate, rectangular passage extending along the wrench head and opening into the bottom of the cavity 11. Fitted within the wrench head are a key 8 and an adjustment assembly 6 for adjusting the position of the key 8 relative to the cavity 11, for varying the size of the cavity, according to the size of nut or bolt head to be fitted in the wrench.

Figure 3:
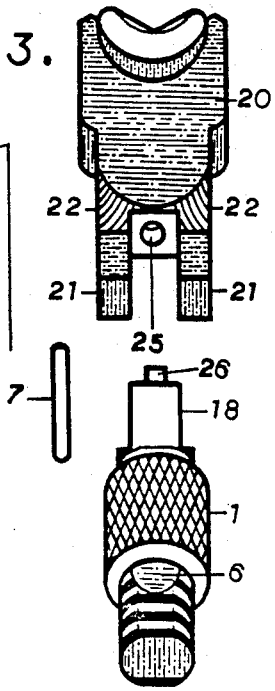
FIG. 3 is an exploded view of the key and adjustment mechanism.

The key 8 has a body 20 with an upper gripping face 3 including two flats formed at an angle of 120° and confronting the gripping face 14 of the cavity 11. The key body 20 has at the opposite, lower end, a pair of spaced apart lugs 21, shown in FIG. 3. The lugs have aligned openings 28 (FIG. 6).

The adjustment assembly for the key includes a threaded stem 18 which is flattened on both its forward and rearward sides to be accommodated in a passage 16 extending from the elongate passage 34. As illustrated in FIGS. 1 and 2, the wrench has an offset handle 32 so that the passage 16 opens at the bottom of the wrench head. The opposite sides of the passage 16 are flats 17 mating with the flattened sides of the stem 18.

The stem 18 has an upper head with a transverse bore 27 and a central, axially extending pilot pin 26. The head of the threaded stem fits between the two lugs 21 of the key and is secured to the key by a pin 7 extending through the bores 27 and 28. The pilot pin 26 locates within a bore 25 in the base of the key body 20. A threaded adjustment nut 1 threads onto the stem 18 and is normally seated in a transverse passage 35 through the wrench head, intersecting the elongate passage at a position spaced from the cavity 11.

Extending through the wrench head, and intersecting the elongate passage 34 is an access port 19. Adjustment of the stem 18 appropriately will bring the pin 7 into line with the access port 19 so that the pin can be driven from the bores 27 and 28, thus freeing the key from the adjustment stem 18. This allows the key to be removed from the wrench head through the cavity 11 and allows the threaded stem to be removed from the wrench head either through the opening 16 or the cavity 11.

The construction of the key enables its removal from either side of the wrench head as illustrated in FIG. 6. This construction includes bevelled faces at the ends of the gripping face of the key, that are rounded from front to back of the key. The lower ends of the legs 21 are bevelled as illustrated at 23. Along the opposite side of the key from the bevels 23, the key body 20 has a notch 22 that is arcuate in shape to match the arcuate shape of each lower edge 15 of the cavity 11. In addition, the side faces of the key body have shoulders 20 that are spaced above the notch 22 and curve upwardly from the face with the bevels 23 to the opposite face, the curvature being towards the gripping face of the key. This configuration allows the key to be removed from the wrench head, as illustrated in FIG. 6. To remove the key, the key is extended fully into the cavity 11, with the notch 22 confronting one of the edges 15. The bevels 24 and 23 allow the key to be cleared past the cavity wall as the key is rotated around the edge 15 and pulled directly out through the cavity 11. The shoulders 4 likewise clear the corners of the cavity 11 at the ends of the edges 15.

The threaded stem 18 has a bevel 5 on one side at its bottom end and a notch 6 in the other side, spaced above the bevel 5. This configuration allows the threaded stem to be withdrawn from the wrench through the cavity 11 as well.

The key and adjustment mechanism of the wrench can be assembled in any orientation. That is, the stem 18 and the key 8 can be inserted into the wrench head either way round, from either side of the cavity 11 or, in the case of the stem 18, from the open end of the passage 16. This greatly facilitates the maintenance of the wrench. At the same time, the provision of lips on opposite sides of the wrench body that extend to the faces 12 and 13 of the wrench head provides a full gripping face on the end of the key on both sides.

The use of an arcuate shoulder 4 allows the key to have as much support surface engaging the inner faces of the passage 34 as possible consistent with the ability to remove the key from the passage.

The wrench head and handle are made as a main forged component and a cover plate 2 that is welded onto the head to cover the passage on the rear side of the wrench head. The main component is illustrated on the left in FIG. 4, while the cover plate 2 is shown on the right in that drawing. The cover plate is welded to the shaded area 30 on the main component.

The handle 32 of the wrench is provided with three elongate belt holes 31. These increase in length from adjacent the wrench head to the end of the handle. They also taper in lateral dimension from the end of the handle towards the wrench head. These are used as a safety measure for carrying the wrench when both hands are needed for other purposes and when it is difficult or impossible to carry a full tool belt or box. The belt loops of variable sizes will accommodate various sizes of belts, from the widest to the narrowest, without excessive play so that the wrench may be strapped to the body with the belt, possibly under a coverall, so that it can be carried with great safety to locations that are difficult to reach.

Although a preferred embodiment of the present invention has been described in the foregoing, it is to be understood that other embodiments are possible within the scope of the invention. The invention is to be considered limited solely by the scope of the appended claims.

I claim:

1. An adjustable wrench comprising:

a handle;

a wrench head attached to the handle, said wrench head having a gripping cavity therethrough, with a first end of the gripping cavity, remote from the handle, configured for engagement with an object to be gripped, an elongate passage in the wrench head opening into the cavity opposite the first end thereof, and a transverse elongate passage through the wrench head, intersecting the passage at a position spaced from the cavity;

a key comprising an elongate body slideable within the elongate passage of the head, and having a gripping end projecting into the cavity and an attachment end opposite the gripping end, the gripping end having a gripping end face confronting the first end of the gripping cavity and a pair of lips projecting from opposite sides of the key to extend the gripping face to opposite side faces of the wrench head, the key body having bevelled edges at the corners of the gripping face, a bevelled surface on a first surface adjacent the attachment end and a transverse, arcuate notch formed across a second surface directly opposite the first surface;

key adjustment means for moving the key along the elongate passage and comprising a threaded stem fixed against rotation within the elongate passage and adapted to engage the end of the key, removable securing means for removably securing the key and stem to one another, a nut engaged with the threaded stem, seated in the transverse passage and projecting to opposite sides of the wrench head;

an access port in the wrench head providing access to said elongate passage so that said securing means can be removed to separate said key and said threaded stem;

said key being removable from said elongate passage by removing said securing means, extending said key into the cavity sufficient to position said notch against an edge of the cavity opposite the first end thereof, and pivoting said key about the edge out of the plane of the gripping cavity for removal from said elongate passage through the gripping cavity, the bevelled surfaces of the key providing sufficient clearance with the surfaces of the elongate passage and the gripping cavity to allow the key to be pivoted in such a manner;

said threaded stem being removable from said elongate passage by rotating the said nut to move the threaded stem out of the elongate passage for removal.

2. A wrench according to claim 1 wherein the threaded stem has flats on opposite sides thereof for longitudinally slideable, non-rotatable engagement along the elongate passage.

3. A wrench according to claim 2 including a notch in one flat of the threaded stem, and a bevelled surface on the opposite flat, at the end remote from the gripping cavity.

4. A wrench according to claim 1 wherein edges of the gripping cavity opposite the first end and on opposite sides of the axial passage have respective central, arcuate, concave sections conforming in shape to the bottom surfaces of the lips of the key.

5. A wrench according to claim 4 wherein the key includes two shoulders on opposite sides thereof, curving from the first surface to the second surface in a direction towards the gripping end.

6. A wrench according to claim 1 wherein the wrench head comprises a head integral with the handle, the head having an elongate cavity in one side thereof bounding the gripping cavity and the elongate passage, and a plate secured over said one side, with an aperture therein defining an opening into the gripping cavity.

7. A wrench according to claim 1 wherein the handle is offset to one side of the wrench head.

8. A wrench according to claim 1 wherein the handle includes a plurality of elongate belt holes therethrough, said holes being of differing lengths and tapering in width towards the wrench head.

* * * * *